United States Patent [19]

Deckard et al.

[11] Patent Number: 4,485,969

[45] **Date of Patent: * Dec. 4, 1984**

[54] ELECTROMAGNETIC UNIT FUEL INJECTOR WITH CARTRIDGE TYPE SOLENOID ACTUATED VALVE

[75] Inventors: John I. Deckard, Grand Rapids; Robert D. Straub, Livonia, both of Mich.

[73] Assignee: General Motors Corporation, Detroit, Mich.

[ * ] Notice: The portion of the term of this patent subsequent to Jul. 12, 2000 has been disclaimed.

[21] Appl. No.: 481,758

[22] Filed: Apr. 4, 1983

Related U.S. Application Data

[63] Continuation-in-part of Ser. No. 350,267, Feb. 19, 1982, Pat. No. 4,392,612.

[51] Int. Cl.[3] ..... F02M 51/06

[52] U.S. Cl. ..... 239/88; 239/585

[58] Field of Search ..... 239/88, 89, 90, 91, 239/124, 585, 95, 96

[56] References Cited

U.S. PATENT DOCUMENTS

| | | | |
|---|---|---|---|
| 2,144,861 | 1/1939 | Truxell, Jr. | 239/90 X |
| 3,006,556 | 10/1961 | Shade et al. | 239/88 |
| 3,777,977 | 12/1973 | Regneault et al. | 239/585 X |
| 3,982,693 | 9/1976 | Hulsing | 239/88 |
| 4,046,112 | 9/1977 | Deckard | 239/96 |
| 4,129,253 | 12/1978 | Bader, Jr. et al. | 239/88 |
| 4,129,254 | 12/1978 | Bader, Jr. et al. | 239/585 X |
| 4,129,255 | 12/1978 | Bader, Jr. et al. | 239/585 X |
| 4,129,256 | 12/1978 | Bader, Jr. et al. | 239/585 X |
| 4,392,612 | 7/1983 | Deckard et al. | 239/585 X |

*Primary Examiner*—John J. Love
*Assistant Examiner*—Jon M. Rastello
*Attorney, Agent, or Firm*—Arthur N. Krein

[57] ABSTRACT

An electromagnetic unit fuel injector for use in a diesel engine includes a housing with a pump therein defined by an externally actuated plunger reciprocable in a bushing and defining therewith a pump chamber open at one end for the discharge of fuel to a spring biased, pressure actuated fuel injection nozzle. The pump chamber is also connected to a first chamber via a solenoid actuated, normally open, hollow pressure balanced poppet valve controlled passage to permit the ingress and egress of fuel. The first chamber adjacent to one end of the valve is in flow communication with a second chamber at the opposite end of the valve and these chambers are connected to a drain passage and supply passage, respectively. During a pump stroke, the solenoid can be energized to move the valve in position to block flow from the pump chamber to the first chamber so as to allow the pressurization of fuel by the pump to effect discharge of fuel from the injection nozzle. In a preferred embodiment the solenoid actuated poppet valve is a cartridge type assembly which is adapted to be received in a suitable socket provided for it in the housing and to be secured therein in hydraulic sealed relationship.

2 Claims, 5 Drawing Figures

ELECTROMAGNETIC UNIT FUEL INJECTOR WITH CARTRIDGE TYPE SOLENOID ACTUATED VALVE

This application is a continuation-in-part of copending application Ser. No. 350,267 filed Feb. 19, 1982 now U.S. Pat. No. 4,392,612 and assigned to the same assignee.

This invention relates to unit fuel injectors of the type used to inject fuel into the cylinders of a diesel engine and, in particular, to an electromagnetic unit fuel injector having a cartridge type solenoid controlled, pressure balanced valve therein.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine driven cam whereby to pressurize fuel to a suitable high pressure so as to effect the unseating of a pressure actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect unseating of the injection valve of the associated fuel injection nozzle. An exemplary embodiment of such an electromagnetic unit fuel injector is disclosed, for example, in U.S. Pat. No. 4,129,253 entitled Electromagnetic Unit Fuel Injector issued Dec. 12, 1978 to Ernest Bader, Jr., John I. Deckard and Dan B. Kuiper.

SUMMARY OF THE INVENTION

The present invention provides an electromagnetic unit fuel injector that includes a pump assembly having a plunger reciprocable in a bushing and operated, for example, by an engine driven cam, with flow from the pump during a pump stroke of the plunger being directed to a fuel injection nozzle assembly of the unit that contains a spring biased, pressure actuated injection valve therein for controlling flow out through the spray tip outlets of the injection nozzles. Fuel flow from the pump can also flow through a passage means, containing a normally open pressure balanced control valve means to a fuel drain passage means. Fuel injection is regulated by the controlled energization of the solenoid actuated pressure balanced valve means whereby it is operative to block flow from the pump to the fuel drain passage means during a pump stroke of the plunger whereby the plunger is then permitted to intensify the pressure of fuel to a value to effect unseating of the injection valve. The pressure balanced valve means is operative to reduce the force required to be applied by the solenoid in the valve means to effect sealing against the high pressure in the passage means during a fuel injection cycle. The solenoid and the pressure balanced valve means are in the form of a cartridge whereby its operation can be calibrated independently of the remaining elements of the unit injector.

It is therefore a primary object of this invention to provide an improved electromagnetic unit fuel injector that contains a cartridge type solenoid actuated pressure balanced valve means controlling injection whereby the solenoid need only operate against a fraction of the fluid pressure generated by the plunger for controlling the start and end of injection.

Another object of the invention is to provide an improved electromagnetic unit fuel injector having a cartridge type solenoid actuated, pressure balanced valve means incorporated therein that is operable upon the controlled energization of the solenoid to control the drain flow of fuel during a pump stroke and which is thus operative to control the beginning and end of fuel injection.

A further object of this invention is to provide an improved electromagnetic unit fuel injector with cartridge type solenoid pressure balanced poppet valve to provide for improved serviceability of the injector and to provide for independent calibration of the solenoid and poppet valve assembly separate from the pump.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
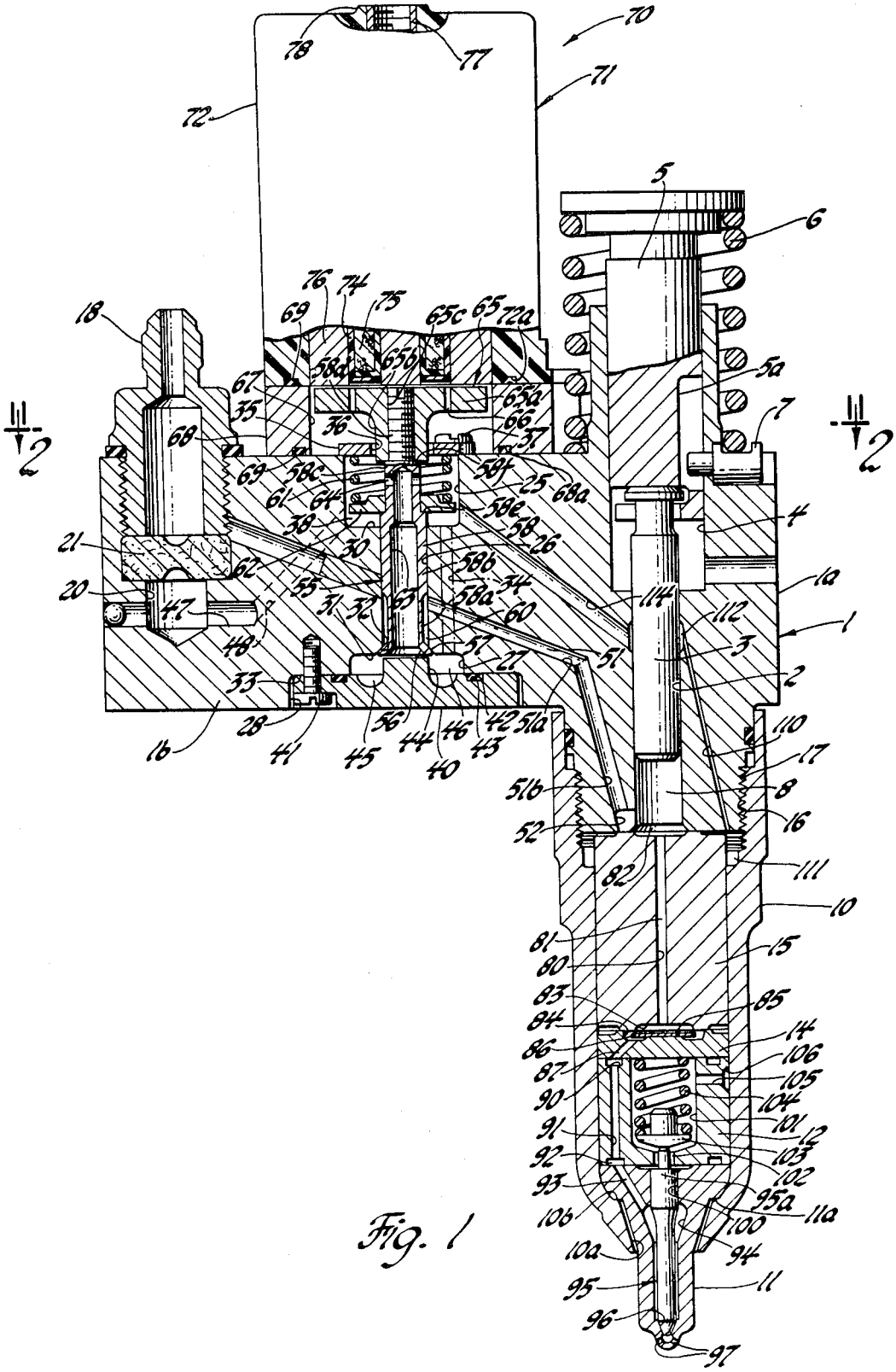
FIG. 1 is a longitudinal sectional view of an electromagnetic unit fuel injector in accordance with the invention, with elements of the injector being shown so that the plunger of the pump thereof is positioned as during a pump stroke and with the electromagnetic valve means thereof energized, and with parts of the unit shown in elevation.
Figure 2:
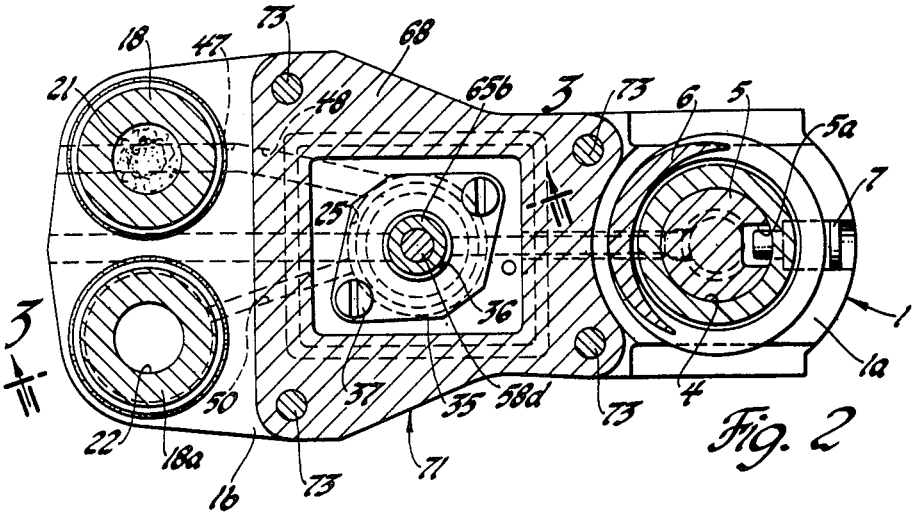
FIG. 2 is a sectional view of the electromagnetic unit fuel injector of FIG. 1 taken as along line 2—2 of FIG. 1.
Figure 3:
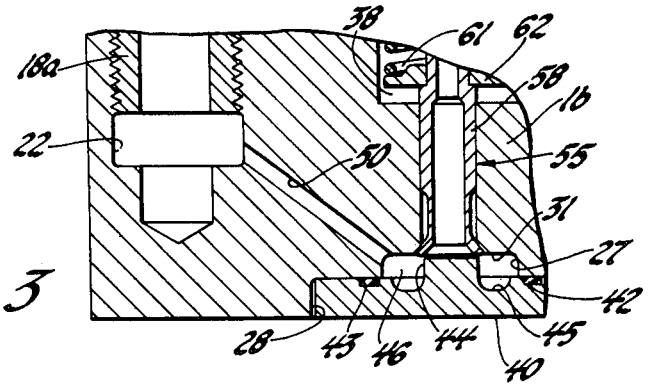
FIG. 3 is a cross-sectional view of a portion of the fuel injector of FIG. 1 taken along line 3—3 of FIG. 2.

Referring now to the drawings and, in particular, to FIGS. 1, 2 and 3, there is shown an electromagnetic unit fuel injector constructed in accordance with the invention, that is, in effect, a unit fuel injector-pump assembly with an electromagnetic actuated, pressure balanced valve incorporated therein to control fuel discharge from the injector portion of this assembly in a manner to be described.

In the construction illustrated, the electromagnetic unit fuel injector includes an injector body 1 which includes a vertical main body portion 1*a* and a side body portion 1*b*. The body portion 1*a* is provided with a stepped bore therethrough defining a cylindrical lower wall or bushing 2 of an internal diameter to slidably receive a pump plunger 3 and an upper wall 4 of a larger internal diameter to slidably receive a plunger actuator follower 5. The follower 5 extends out one end of the body 1 whereby it and the plunger connected thereto are adapted to be reciprocated by an engine driven cam or rocker, in the manner shown schematically in FIG. 4, and by a plunger return spring 6 in a conventional manner. A stop pin 7 extends through an upper portion of body 1 into an axial groove 5*a* in the follower 5 to limit upward travel of the follower.

The pump plunger 3 forms with the bushing 2 a pump chamber 8 at the lower open end of the bushing 2, as shown in FIG. 1.

Forming an extension of and threaded to the lower end of the body 1 is a nut 10. Nut 10 has an opening 10*a* at its lower end through which extends the lower end of a combined injector valve body or spray tip 11, hereinafter referred to as the spray tip, of a conventional fuel injection nozzle assembly. As shown, the spray tip 11 is enlarged at its upper end to provide a shoulder 11*a* which seats on an internal shoulder 10*b* provided by the through counterbore in nut 10. Between the spray tip 11 and the lower end of the injector body 1 there is positioned, in sequence starting from the spray tip, a rate spring cage 12, a spring retainer 14 and a director cage 15, these elements being formed, in the construction illustrated, as separate elements for ease of manufacturing and assembly. Nut 10 is provided with internal threads 16 for mating engagement with the external threads 17 at the lower end of body 1. The threaded connection of the nut 10 to body 1 holds the spray tip 11, rate spring cage 12, spring retainer 14 and director cage 15 clamped and stacked end-to-end between the upper face 11*b* of the spray tip and the bottom face of body 1. All of these above-described elements have lapped mating surfaces whereby they are held in pressure sealed relation to each other.

Fuel, as from a fuel tank via a supply pump and conduit, not shown, is supplied at a predetermined relatively low supply pressure to the lower open end of the bushing 2 by a fuel supply passage means which, in the construction shown, includes a conventional apertured inlet or supply fitting 18 which is threaded into an internally threaded, vertical, blind bore, inlet passage 20 provided adjacent to the outboard end of the side body portion 1*a* of the injector body 1. As best seen in FIG. 1, a conventional fuel filter 21 is suitably positioned in the inlet passage 20 and retained by means of the supply fitting 18. As best seen in FIGS. 2 and 3, a second internally threaded, vertical blind bore in the side body portion 1*a* spaced from the inlet passage 20 defines a drain passage 22 with a fitting 18*a* threaded therein, for the return of fuel as to the fuel tank, not shown.

In addition and for a purpose to be described in detail hereinafter, the side body portion 1*a* is provided with a stepped vertical bore therethrough which defines a circular, internal upper wall 25, an intermediate or valve stem guide wall 26, a lower intermediate wall 27 and a lower wall 28. Walls 25 and 27 are both of larger internal diameters than the internal diameter of wall 26 and wall 28 is of a larger internal diameter than the internal diameter of wall 27. Walls 25 and 26 are interconnected by a flat shoulder 30. Wall 27 is connected to wall 26 by a flat shoulder 31 and by an annular conical valve seat 32, the latter encircling wall 26. Walls 27 and 28 are interconnected by a flat shoulder 33. A second through bore, parallel to but spaced from the valve stem guide wall 26 and extending from shoulder 30 through shoulder 31 defines a pressure equalizing passage 34 for a purpose to be described in detail hereinafter.

As shown in FIG. 1, a spring retainer 35, with a central aperture 36 therethrough is suitably secured as by screws 37 to the upper surface of the side body portion 1*a* with the axis of its aperture 36 aligned with that of the bore defining the valve stem guide wall 26. The lower face of this spring retainer defines a supply/cavity 38 with the upper bore wall 25 and shoulder 30.

As shown in FIGS. 1 and 3, a closure cap 40, of a suitable diameter so as to be loosely received in the lower wall 28 of the side body portion 1*b* is suitably secured, as by screws 41, with its upper surface in abutment against the flat shoulder 33. An O-ring seal 42 positioned in an annular groove 43 provided for this purpose in the closure cap 40 effects a seal between this closure cap and the flat shoulder 33. As illustrated, the closure cap 40 is provided with a central upstanding boss 44, of predetermined height, and preferably, with an annular groove 45 surrounding the boss, as best seen in FIGS. 1 and 3, for a purpose to be described hereinafter. The upper face of the closure cap 40 defines with the wall 27 and shoulder 31 a spill cavity 46.

As best seen in FIGS. 1 and 2, the inlet passage 20 communicates via a horizontal inlet conduit 47 and a connecting upwardly inclined inlet conduit 48 that breaks through the wall 25 with the supply/cavity 38 and, as best seen in FIG. 3, the drain passage 22 communicates via a downwardly inclined drain conduit 50 with the spill cavity 46, this conduit opening through wall 27 and a portion of shoulder 31 into the spill cavity.

A passage 51 for the ingress and egress of fuel to the pump chamber 8 includes a downwardly inclined first portion 51*a* which, as shown in FIG. 1, opens at one end through the valve stem guide wall 26 a predetermined distance above the valve seat 32 and at its other end is connected to one end of a second downwardly inclined portion 51*b*. The opposite end of the second portion 51*b* of passage 51 opens into an arcuate chamber 52 opening into the pump chamber 8 at the lower end of the injector body.

Fuel flow between the spill cavity 46 and passage 50 is controlled by means of a solenoid actuated, pressure balanced valve 55, in the form of a hollow poppet valve. The valve 55 includes a head 56 with a conical valve seat surface 57 thereon, and a stem 58 extending upward therefrom. The stem including a first stem portion 58*a* of reduced diameter next adjacent to the head 56 and of an axial extent so as to form with the guide wall 26 and annulus cavity 60 that is always in fuel communication with the passage 51 during opening and closing movement of the poppet valve, a guide stem portion 58*b* of a diameter to be slidably guided in the valve stem guide wall 26, an upper reduced diameter portion 58*c* and a still further reduced diameter, externally threaded free end portion 58*d* that extends axially up through the aperture 36 in spring retainer 35. Portions 58*b* and 58*c* are interconnected by a flat shoulder 58*e*. Portions 58*c* and 58*d* are interconnected by a flat shoulder 58*f*. The valve 55, is normally biased in a valve opening direction, downward with reference to FIG. 1, by means of a coil spring 61 loosely encircling the portion 58*c* of the valve stem 58. As shown, one end of the spring abuts against a washer-like spring retainer 62 encircling stem portion 58*c* so as to abut against shoulder 58*e*. The other end of spring 61 abuts against the lower face of the spring retainer 35.

In addition, the head 56 and stem 58 of the valve 55 is provided with a stepped blind bore so as to materially reduce the weight of this valve and so as to define a pressure relief passage 63 of a suitable axial extent whereby at its upper end it can be placed in fluid communication via radial ports 64 with the supply/valve spring cavity 38.

Movement of the valve 55 in valve closing direction, upward with reference to FIG. 1, is effected by means of a solenoid assembly 70 which includes an armature 65 having a stem 65*b* depending centrally from its head 65*a* which in the construction illustrated is of rectangular configuration. Armature 65 is suitably secured to valve 55, as by having the internally threaded bore 65*c* therethrough threadedly engaged with the threaded stem portion 58*d* of the valve 55. The armature 65 is also provided with a plurality of passages 66 which extend through the head 65*a* thereof for the passage of fuel during movement of the armature toward the opposed working face of an associated pole piece 78. As best seen in FIG. 1, the armature is loosely received in the complimentary shaped armature cavity 67 provided in a solenoid spacer 68.

As shown, the solenoid assembly 70 further includes a stator assembly, generally designated 71, having a flanged inverted cup-shaped solenoid case 72, made for example, of a suitable plastic such as glass filled nylon, which is secured as by screws 73, FIG. 2, to the upper surface of the side body portion 1*b*, with the solenoid spacer 68 sandwiched therebetween, in position to encircle the spring retainer 35 and bore wall 25. A coil bobbin 74, supporting a wound solenoid coil 75 and, a segmented multi-piece pole piece 76 are supported within the solenoid case 72. In the construction illustrated, the lower surface of the pole piece 76 is aligned with the lower surface of the solenoid case 72, as shown in FIG. 1. With this arrangement, the thickness of the solenoid spacer 68 is preselected relative to the height of the armature 65 above the upper surface of the side body portion 1*b* when valve 55 is in its closed position, the position shown in FIG. 1, so that a clearance exists between the upper working surface of the armature and the plane of the upper surface of the solenoid spacer whereby a minimum fixed air gap will exist between the opposed working faces of the armature and pole piece. In a particular embodiment this minimum air gap was 0.103 to 0.113 mm.

Figure 4:
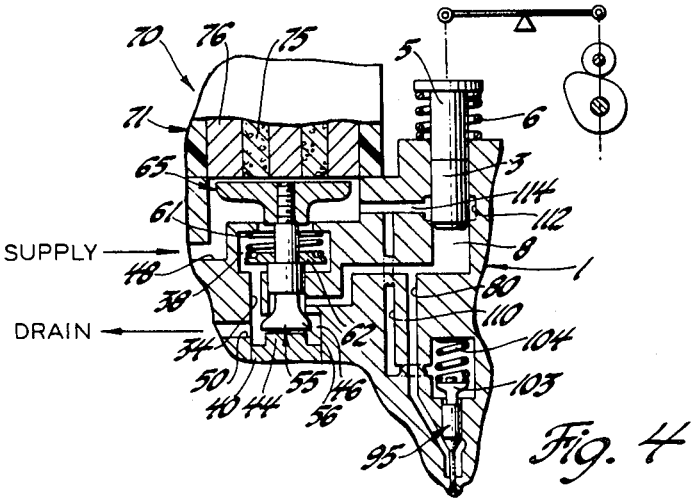
FIG. 4 is a schematic illustration of the primary operating elements of an electromagnetic unit fuel injector constructed in accordance with the invention, with the plunger shown during a pump stroke and with the electromagnetic valve means energized.

Also as best seen in FIGS. 1, 3 and 4, the head 56 of valve 55 is positioned closely adjacent to but spaced a predetermined clearance distance above the free end of boss 44 on closure cap 40, when the valve is in the closed position as shown in these Figures. This distance is selected, as desired, whereby the free end of the boss 44 is operatively positioned whereby to limit travel of the valve 55 in a valve opening direction, downward with reference to these Figures. Thus reference to the particular embodiment previously referred to hereinabove, this clearance distance was 0.103 to 0.113 mm.

The solenoid coil 75 is connectable, by electrical conductors, not shown, suitably adapted for attachment to the pair of internally threaded terminal leads 77 in the pair of apertured upstanding bosses 78, only one lead and boss being shown in FIG. 1, to a suitable source of electrical power via a fuel injection electronic control circuit, not shown, whereby the solenoid coil can be energized as a function of the operating conditions of an engine in a manner well known in the art.

As illustrated in FIG. 1, suitable O-ring seals 69 positioned in suitable annular grooves 68*a* and 72*a* provided for example in the solenoid spacer 68 and solenoid case 72, respectively, are used to effect a seal between the side body portion 1*b* and the solenoid spacer 68 and between this spacer and the solenoid case 72.

During a pump stroke of plunger 3, fuel is adapted to be discharged from pump chamber 8 into the inlet end of a discharge passage means 80 to be described next hereinafter.

An upper part of this discharge passage means 80, with reference to FIG. 1, includes a vertical passage 81 extending from an upper recess 82 through director cage 15 for flow communication with an annular recess 83 provided in the lower surface of director cage 15.

As shown in FIG. 1, the spring retainer 14 is provided with an enlarged chamber 84 formed therein so as to face the recess 83 and, projecting upwardly from the bottom of the chamber 84 is a protuberance 85 which forms a stop for a circular flat disc check valve 86. The chamber 84 extends laterally beyond the extremities of the opening defining recess 83 whereby the lower end surface of the director cage 15 will form a seat for the check valve 86 when in a position to close the opening defined by recess 83.

At least one inclined passage 87 is also provided in the spring retainer 14 to connect the chamber 84 with an annular groove 90 in the upper end of spring cage 12. This groove 90 is connected with a similar annular groove 92 on the bottom face of the spring cage 12 by a longitudinal passage 91 through the spring cage. The lower groove 92 is, in turn, connected by at least one inclined passage 93 to a central passage 94 surrounding a needle valve 95 movably positioned within the spray tip 11. At the lower end of passage 94 is an outlet for fuel delivery with an encircling tapered annular seat 96 for the needle valve 95 and, below the valve seat are connecting spray orifices 97 in the lower end of the spray tip 11.

The upper end of spray tip 11 is provided with a bore 100 for guiding opening and closing movements of the needle valve 95. The piston portion 95*a* of the needle valve slidably fits this bore 100 and has its lower end exposed to fuel pressure in passage 94 and its upper end exposed to fuel pressure in the spring chamber 101 via an opening 102, both being formed in spring cage 25. A reduced diameter upper end portion of the needle valve 95 extends through the central opening 102 in the spring cage and abuts a spring seat 103. Compressed between the spring seat 103 and spring retainer 14 is a coil spring 104 which biases the needle valve 95 to its closed position shown.

In order to prevent any tendency of fuel pressure to build up in the spring chamber 101, this chamber, as shown in FIG. 1, is vented through a radial port passage 105 to an annular groove 106 provided on the outer peripheral surface of spring cage 12. While a close fit exists between the nut 10 and the rate spring cage 12, spring retainer 14 and director cage 15, there is sufficient diametral clearance between these parts for the venting of fuel back to a relatively low pressure area, such as at the supply/valve spring cavity 38.

In the construction illustrated, this fuel is drained back to the supply/valve spring cavity 38 via an inclined passage 110 in injector body 10 which opens at its lower end into a cavity 111 defined by the internal wall of the nut and the upper end of director cage 15 and at its upper end open into an annular groove 112 encircling plunger 3 and then via an inclined passage 114 for flow communication with the supply/valve spring chamber 38.

FUNCTIONAL DESCRIPTON

Referring now in particular to FIGS. 1 and 4, during engine operation, fuel from a fuel tank, not shown, is supplied at a predetermined supply pressure by a pump, not shown, to the subject electromagnetic unit fuel injector through a supply conduit, not shown, connected to the supply fitting 18. Fuel as delivered through the supply fitting 18 flows into the inlet passage 20 and then through the inlet conduits 47 and 48 into the supply/cavity 38. From this cavity 38 fuel is then free to flow into the spill cavity 46 either by the pressure equalizing passage 34 or the pressure relief passage 63 and ports 64.

When the solenoid coil 75 of the solenoid assembly 70 is de-energized, the spring 61 will be operative to open and hold open the valve 55 relative to the valve seat 32. At the same time the armature 65, which is connected to valve 55, is also moved downward, with reference to FIGS. 1 and 4, relative to the pole piece 76 whereby to establish a predetermined working air gap between the opposed working surfaces of these elements.

With the valve 55 in its open position, fuel can flow from the spill cavity 46 into the annulus cavity 60 and then via passage 51 and arcuate chamber 52 into the pump chamber 8. Thus during a suction stroke of the plunger 3, the pump chamber will be resupplied with fuel. At the same time, fuel will be present in the discharge passage means 80 used to supply fuel to the injection nozzle assembly.

Thereafter, as the follower 5 is driven downward, as by a cam actuated rocker arm, in the manner schematically illustrated in FIG. 4, to effect downward movement of the plunger 3 this downward movement of the plunger will cause fuel to be displaced from the pump chamber 8 and will cause the pressure of the fuel in this chamber and adjacent passages connected thereto to increase. However with the solenoid coil 75 still de-energized, this pressure can only rise to a level that is a predetermined amount less than the "pop" pressure required to lift the needle valve 95 against the force of its associate return spring 104.

During this period of time, the fuel displaced from the pump chamber 8 can flow via the passage 51 and the annulus cavity 60 back into the spill cavity 46 and then from this cavity the fuel can be discharged via the drain conduit 50, drain passage 22 and drain fitting **18*a*** for return, for example, via a conduit, not shown, back to the fuel tank containing fuel at substantially atmospheric pressure. As is conventional in the diesel fuel injection art, a number of electromagnetic unit fuel injectors can be connected in parallel to a common drain conduit, not shown, which normally contains an orifice passage therein, not shown, used to control the rate of fuel flow through the drain conduit whereby to permit fuel pressure at a predetermined supply pressure to be maintained in each of the injectors.

Thereafter, during the continued downward stroke of the plunger 3, an electrical (current) pulse of finite characteristic and duration (time relative for example to the top dead center of the associate engine piston position with respect to the cam shaft and rocker arm linkage) applied through suitable electrical conductors to the solenoid coil 75 produces an electromagnetic field attracting the armature 65 to effect its movement toward the pole piece 76. This upward movement, with reference to FIGS. 1 and 4, of the armature 65, as coupled to the valve 55, will effect seating of the valve 55 against its associate valve seat 32, the position of these elements shown in these Figures. As this occurs, the drainage of fuel via the passage 51 and the annulus cavity 60 will no longer occur and this then permits the plunger 3 to increase the pressure of fuel to a "pop" pressure level to effect unseating of the needle valve 95. This then permits the injection of fuel out through the spray orifices 97. Normally, the injection pressure increases during further continued downward movement of the plunger.

Ending the current pulse causes the electromagnetic field to collapse, allowing the spring 61 to again open the valve 55 and to also move the armature 65 to its lowered position. Opening of the valve 55 again permits fuel flow via the passage 51 and annulus cavity 60 into the spill cavity 46. This drainage flow of fuel thus releases the system pressure in the discharge passage means 80 whereby the spring 104 can again effect closure of the needle valve 95.

Again referring to the valve 55, as illustrated this valve is constructed with a hollow center to provide four functions:

(1) mass reduction of the valve to increase its response and operational speeds;
(2) reduce valve seat stiffness to allow valve seating with a minimum force;
(3) decrease valve stiffness to reduce valve seat impact loads; and
(4) the formation of a passage 63 directly connecting the head 56 end of the valve to a low pressure cavity, that is, to the supply/cavity 38 by means of one or more ports 64 in order to maximize the valve opening response (speed).

How the fourth function, maximization of valve opening speed, is accomplished can be best understood by considering the valve operation during opening movement thereof relative to the valve seat 32. When the valve 55 first starts to open after the armature 65 is released by the electromagnetic stator assembly 71 and accelerated by the force of the valve spring 61, it will provide a flow path between the high pressure in the annulus cavity 60 and the spill cavity 46, the latter normally containing fuel at a relatively low supply pressure.

This opening movement of the valve 55 results in the rapid flow of fuel from the annulus cavity 60 into the spill cavity 46 and an increase in the pressure of fuel within the spill cavity 46 due to the limited capacity of this cavity and the finite inertia and fluid friction in the associate passages connecting the spill cavity 46 to other low supply pressure regions. However, by connecting the valve head 56 directly to a lower pressure region, that is, the supply pressure region in the supply/cavity 38, by means of the pressure relief passage 63 and radial ports 64 previously described, the hydraulic force acting on the head 56 of valve 55 due to the increased pressure in the spill cavity 46 will be minimized and the opening time of the valve 55 minimized due to the higher net amount of force available to accelerate the valve 55 in the valve opening direction. Also, as shown, in FIGS. 1 and 3, the valve stem guide wall 26 and the effective working contact surface of the valve seat 32 are of the same diameter whereby to provide for equal and opposite hydraulic forces acting on valve 55. That is, the opposed working areas of valve 55 exposed to the pressure of fuel in the annulus cavity 60 are equal as shown in these Figures.

In addition by providing the pressure equalization passage 34 between the spill cavity 46 and the supply/-cavity 38 at the armature end of the valve assembly, an additional increase in valve opening speed is realized due to the pressure equalization across the valve in the manner described hereinabove.

In addition to the above, by limiting the area for pressure communication between the spill cavity 46 and the valve head 56 end of valve 55 by the positioning of the boss 44, as illustrated, a further improved increase in valve opening speed is obtained.

Figure 5:
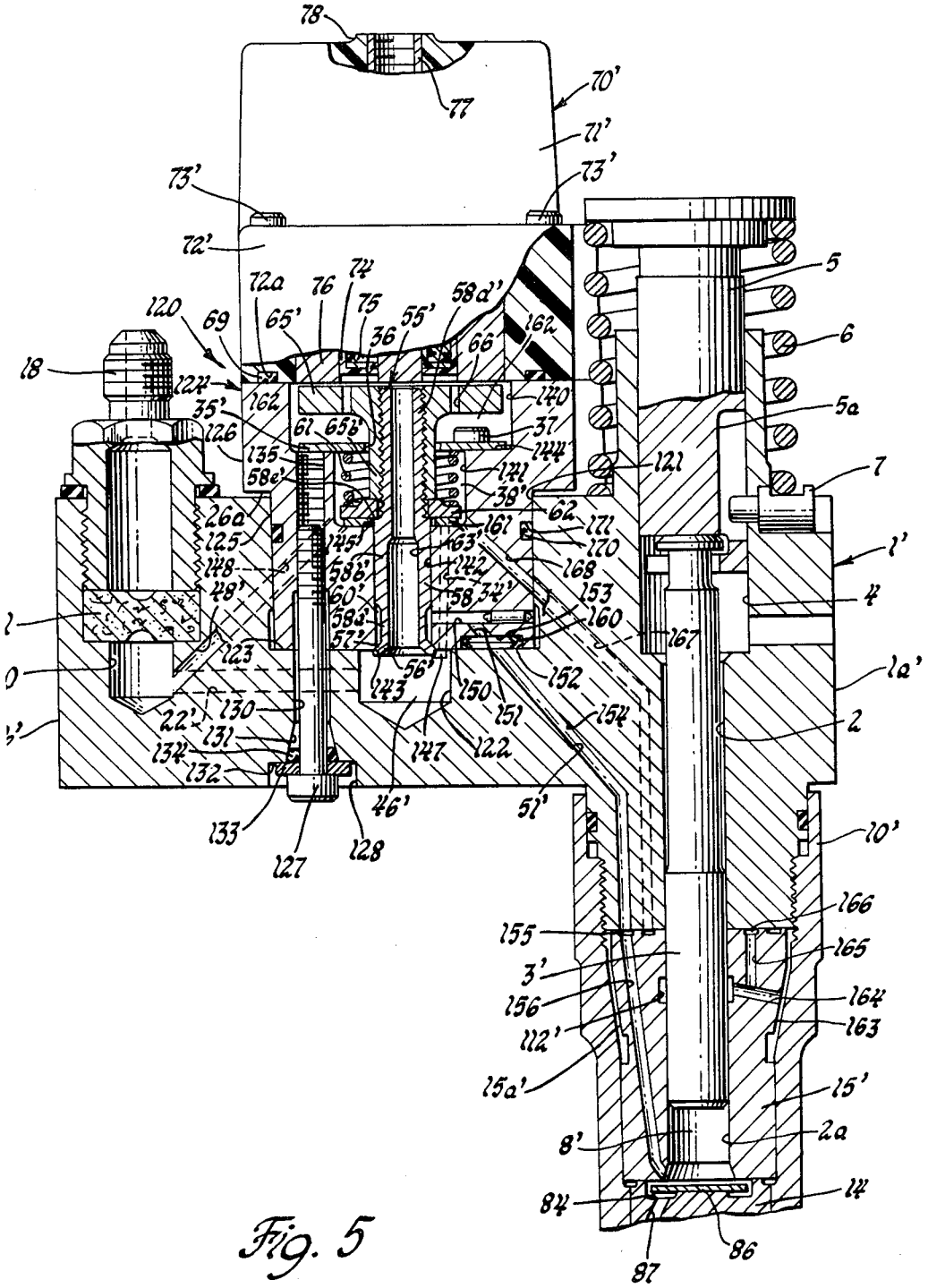
FIG. 5 is a longitudinal sectional view of an electromagnetic unit fuel injector with cartridge type solenoid actuated pressure balanced poppet valve in accordance with a preferred embodiment of the invention, this view in other respects being similar to that of FIG. 1, but with the lower end of the nut and conventional parts of the fuel injection nozzle assembly not being shown.

A preferred embodiment of an electromagnetic unit fuel injector, in accordance with the subject invention, is shown in FIG. 5 wherein similar parts are designated by similar numerals but with an addition of a prime (') where appropriate. In accordance with a feature of the present invention, in this embodiment, the unit injector is provided with a cartridge type, solenoid actuated, pressure balance poppet valve assembly, generally designated 120, and, it is also provided with a separate bushing 15', having a hardened bushing bore 2*a* therein, that is retained by means of the nut 10' in stacked relationship between the spring retainer 14 and the lower end of the injector body 1'. The bushing 15' is thus positioned in the same manner as the director cage 15 of the FIG. 1 embodiment and thus replaces that director cage, with the check valve 86 in the FIG. 5 embodiment being adapted to seat against the lower surface of bushing 15'.

With this arrangement, the injector body 1' in this embodiment need not have the bores accommodating the plunger and poppet valve suitably hardened as would be required in the FIGS. 1–4 embodiment since these are now formed as separate elements and not part of the injector body.

In this embodiment the elongated plunger 3' thus forms with the bushing 2*a*, in the bushing 15', a pump chamber 8' next adjacent to the spring retainer 14. The main body portion 1*a'* of the injector 1' is also provided with a stepped bore therethrough defining a lower wall 2 and an upper wall 4, the latter to receive the follower 5 and the former to slidably receive the plunger 3', the upper part of which is of reduced external diameter, as shown in FIG. 5, so that this portion of the plunger is loosely received by the bore wall 2.

The side body portion 1*b'* of the injector body 1', in the embodiment of FIG. 5, is provided with a socket for the solenoid actuated, pressure balanced poppet valve assembly 120 formed, in the construction illustrated by a vertical, stepped blind bore which defines a circular internal upper wall 121 and a lower wall 122 that is of reduced diameter relative to wall 121. Walls 122 and 121 are interconnected by a flat shoulder 123. It should be noted that the upper wall 121 is suitably enlarged at its lower end so that the shoulder 123 can be machined flat to a diameter corresponding at least to the diameter of the upper major constant diameter portion of the wall 121.

Referring now to the solenoid actuated pressure balance poppet valve assembly 120, this assembly is a cartridge type replacement assembly which includes a valve cage or body 124 of stepped external dimensions so as to include a lower cylindrical body portion 125 and an enlarged upper body portion 126 with a flat shoulder 126*a* interconnecting these portions.

The lower body portion 125 is of a suitable external diameter and of a predetermined axial extent greater than that of wall 121 so as to be received by the upper wall 121 in a manner whereby the lower surface of the valve body will abut in sealing relationship against the shoulder 123 in the side body portion 1*b*.

The valve body 124 is adapted to be secured in the cavity defined by the bore wall 121 and flat shoulder 123 by means of hex socket machine screws 127, three such screws being used in the construction illustrated, with only one such screw being shown in FIG. 5.

For this purpose, in the construction illustrated in FIG. 5, the side body portion 1*b'* is provided with three equally spaced apart screw receiving stepped bores that extend from the lower surface of the side body portion through the flat shoulder 123. In the construction shown, each such bore defines a circular internal lower enlarged diameter wall 128 and an upper wall 130 of an internal diameter so as to loosely receive the shank of a screw 127, with a tapered seal wall 131 interconnecting the walls 128 and 130. Walls 128 and 131 are interconnected by a flat shoulder 132 which is of suitable diameter so as to receive a washer 133 sandwiched between the shoulder 132 and the head of the associate screw 127. An O-ring seal 134 is positioned to sealingly engage the shank of the screw 127 and to sealingly engage the seal wall 131. Each of these bores is axially aligned with internally threaded apertures 135 provided in the valve body 124 so as to receive the screws 127 whereby to affect retention of the valve body and to affect its proper angular alignment within the side body portion 1*b'* for a purpose which will become apparent hereinafter.

Valve body 124 is also provided with a central stepped vertical bore therethrough that defines an upper wall 140, an intermediate wall 141 and a valve stem guide wall 142, the free end of which is encircled by an annular conical valve seat 143. Walls 141 and 142 are of increasingly smaller internal diameters than the internal diameter of wall 140. Walls 140 and 141 are interconnected by a flat shoulder 144. Walls 141 and 142 are interconnected by a flat shoulder 145.

A second through bore 34', radially offset from the valve stem guide wall 142, extends from the shoulder 145 through the lower end face of the valve body 124 to define a pressure equalizing passage that opens into a radial groove 147 formed in the wall 122 of the side body portion 1*b'* for a purpose similar to that of the pressure equalizing passage 34 previously described.

A spring retainer 35' with a central aperture 36 is suitably secured, as by screws 37, to the shoulder 144 in the valve body 124, with the aperture 36 located concentric with the guide wall 142. The lower face of the spring retainer 35' defines a supply cavity 38' with the bore wall 141 and shoulder 145. In addition, the central lower end face of the valve body 124 defines with the bore wall 122 a spill cavity 46'.

In the construction shown in FIG. 5, the inlet passage 20 in the side body portion 1*b'* communicates via an inclined conduit 48' formed in the injector body 1' that is positioned so as to align with an inclined passage 148 formed in the valve body 124 that opens into the supply cavity 38'. A drain conduit 22' is used to effect flow communication between the spill cavity 46' and the usual drain fitting in the manner as shown in FIG. 2.

A passage 51' for the ingress and egress of fuel to the pump chamber 8' includes a horizontal passage 150 formed in the valve body 124 so as to extend from the valve stem guide wall 142, at a predetermined distance above the valve seat 143, to interconnect with a downwardly inclined passage 151 that opens into a recessed seal pocket formed by a bore extending from the lower surface of the valve body to define an annular wall 152 and a flat seal shoulder 153, the latter being located a predetermined distance from the bottom surface of the valve body 124.

Passage 51' further includes an inclined and then vertically extending passage 154 formed in the injector body 1', with one end of this passage 154 extending from the shoulder 123 at a location so as to be encircled by the wall 152 and which at its other end opens through the lower end face of the main body portion **1*a*' for flow communication with an annular groove 155 provided in the upper end of the bushing 15'. A longitudinal passage 156 in the bushing 15' extends from the groove 155 to open through the bushing bore 2*a* wall into the pump chamber 8' at a location below the predetermined maximum travel of the plunger 3'** on a pump stroke.

Since the passage 51' is used to supply fuel to the pump chamber 8' during a suction stroke of the plunger 3' and for the spill of pressurized fuel from this chamber during a pump stroke of the plunger, a suitable high pressure seal is suitably positioned so as to effect a seal between the valve body 124 and the valve assembly socket in the side body portion **1*b*'** to prevent leakage of high pressure fuel.

For this purpose in the construction illustrated, the high pressure seal is a commercially available metal V-type seal 160, of circular configuration, that is positioned in the seal pocket so as to be encircled by the wall 152 with opposed upper and lower edges of this seal abutting against the opposed surfaces of the seal shoulder 153 in the valve body 124 and the flat shoulder 123 in the side body portion **1*b*'. The seal 160 is thus positioned to encircle passages 151 and 154**.

Fuel flow between the spill cavity 46' and the passage 51' and thus, in effect, between the supply cavity 38' and this passage is controlled by means of a pressure balanced valve 55' in the form of a hollow poppet valve. Valve 55' includes a head 56' with a conical valve seat 57' thereon and a stem 58' extending therefrom. Stem 58' includes a first stem portion **58*a*' of reduced diameter next adjacent to the head 56', with this portion 58*a*' being of a suitable axial extent so as to form with the guide wall 142 an annulus cavity 60' that is always in fuel communication with the passage 150 during opening and closing movement of the poppet valve. Valve stem 58' further includes a guide stem portion 58*b*' slidably guided in the valve stem guide wall 142 and an upper reduced diameter portion 58*d*' that is suitably threaded for threaded engagement in the internally threaded armature 65'**.

The angle of the valve seat 57' on the valve head 56' and the angle of the valve seat 143 on the valve body 124 are preselected relative to each other so that the valve seat 57' engages the valve seat 143 at its connecting edge with the valve stem guide wall 142 whereby when the poppet valve 55' is in its closed position, as during the period when the solenoid is energized during a pump stroke, the high pressure fuel then in the annular cavity 60' will act against opposed surfaces of equal area on the valve. Thus the term pressure balanced valve. With this arrangement, minimum force is then required to hold the poppet valve closed against the preselected force of the valve return spring 61.

Poppet valve 55' is normally biased in a valve opening direction, that is, in a downward direction with reference to the assembly configuration shown in FIG. 5, by means of a coil valve return spring 61 loosely encircling the reduced diameter stem portion **65*b*' of armature 65' as shown, with one end of the spring 61' in abutment against a washer-like spring retainer 62 encircling stem portion 58*d*' so as to abut against the shoulder 58*e*' interconnecting stem portions 58*b*' and 58*d*'. The other end of the spring 61' abuts against the lower face of the spring retainer 35'**.

A spacer washer 161, of a predetermined thickness as desired, loosely encircles the stem **58*b*' of the poppet valve and is positioned so as to abut against the shoulder 145 to serve as a stop for the spring retainer 62 whereby to limit downward movement thereof and thus to limit the opening travel of the poppet valve, as desired. In a particular application, the spacer washer is selected for 0.103 to 0.113 mm valve travel from a closed position to its open position. Armature 65' is also preselected so as to permit this desired travel of the poppet valve 55'** between its open and closed positions.

Spacer washer 161 is preferably of a suitable outside diameter so as not to cover over the pressure equalizing passage 146 or the drain passage 168 provided in valve body 124, as shown, or alternately it can be provided with suitable apertures, not shown, therethrough that are aligned with these passages so as to permit flow communication between these passages and the supply cavity 38'.

In addition, in the construction shown, a stepped bore extends axially through the poppet valve 55' so as to define a pressure relief passage 63' therethrough. Also as shown in FIG. 5, the supply cavity 38' is in direct flow communication via the annular clearance between the spring retainer plate 35' and the stem portion **65*b*' of armature 65' with the armature cavity 162 defined in part by the wall 140 which loosely encircles the armature. Thus the pressure relief passage 63', in effect, provides flow communication between the spill cavity 46' and the supply cavity 38' via the armature cavity 162 and the above-described annular clearance passage with the previously described pressure equalizing passage 34', previously described, also permitting direct flow communication between the supply cavity 38' and the spill cavity 46'**.

Movement of the poppet valve 55' in a valve closing direction, upward with reference to FIG. 5, is accomplished by means of a solenoid assembly 70' which includes the armature 65' fixed to the poppet valve in the manner described hereinabove.

The solenoid assembly 70' further includes a stator assembly 71' which is similar in construction to that shown and described with reference to FIG. 1, except that in this embodiment the solenoid case 72' is of stepped external configuration as shown in FIG. 5. This solenoid assembly 70' is suitably secured in unit assembly with the valve body 124 and the components mounted therein as by means of screws 73' which extend through the solenoid case 72' for threaded engagement in suitable internally threaded apertures, not shown, provided for this purpose in the valve body.

In the construction shown in FIG. 5, fuel leakage into the usual diametral clearance between the elements of the fuel injection nozzle assembly and the nut 10' will flow into an annular drain cavity 163 defined by the upper reduced diameter portion 15*a* of the bushing 15' and the interior wall the nut 10'.

The fuel in this cavity, in the construction illustrated, is drained back as to the supply cavity 38' via a radial passage 164 in the bushing 15' that opens at its inboard end into an annular groove 112' encircling plunger 3' and which, intermediate its ends, is in flow communication with an axial extending passage 165 formed in the director cage so as to open at its upper end into an annular groove 166 provided in the upper end surface of the bushing 15' located concentric with and radially inward of groove 155.

An upward extending passage 167 provided in the injector body 1' has its lower end located so as to communicate with the groove 166 and its upper end is located so as to be in alignment with an inclined drain passage 168 provided in the valve body 124, the upper end of this drain passage 168 breaking through the wall 141 and shoulder 145 into the supply cavity 38'.

As shown, an annular seal ring 170, positioned in an annular groove 171 in the lower reduced diameter portion 125 of the valve body 124 is used to effect a seal between this valve body portion and the wall 121 of the injector body at a suitable location above the lower extremity of the drain passage 168.

The operation of the electromagnetic unit fuel injector embodiment of FIG. 5 is similar to that of the unit injector embodiment of FIGS. 1 to 4 as previously described hereinabove.

However, since in the FIG. 5 embodiment, the solenoid actuated, pressure balanced poppet valve assembly 120 is in the form of a cartridge type unit, it can be calibrated and tested independently of the remaining components of the unit injector. In addition, such a cartridge type assembly can be rapidly disconnected from a unit injector body and replaced by another previously calibrated cartridge type assembly.

While the invention has been described with reference to particular embodiments disclosed herein, it is not confined to the details set forth since it is apparent that various modifications can be made by those skilled in the art without departing from the scope of the invention. For example, the passage 51' in the FIG. 5 embodiment could extend radially into the side of the valve body 124 whereby large high pressure seals can be used above and below this passage to effect seals between the valve body 124 and the injector body. This application is therefore intended to cover such modifications or changes as may come within the purposes of the invention as defined by the following claims.

The embodiments of the invention in which an exclusive property or privilege is claimed are defined as follows:

1. An electromagnetic unit fuel injector with a replaceable, cartridge type solenoid actuated poppet valve, said injector including a housing means having a blind, stepped socket therein defining at the blind end thereof a spill chamber and a fuel supply passage for receiving fuel and a drain passage in communication with said stepped socket, a pump cylinder means in said housing means, an externally actuated plunger reciprocable in said cylinder means to define therewith a pump chamber, a valve controlled injection nozzle means at the opposite end of said housing means in flow communication with said pump chamber, a supply/pressure passage means interconnecting said pump chamber to said spill chamber, said cartridge type solenoid actuated poppet valve being adapted to be secured in said socket in hydraulic sealed relationship to said housing means and to partly enclose said spill chamber, said solenoid actuated poppet valve including a valve body means having a stepped bore therethrough to define a supply chamber and a valve stem guide bore extending therefrom with a valve seat encircling said guide bore at the end thereof opposite said supply chamber, a first passage means for interconnecting said supply passage to said supply chamber, a second passage means interconnecting said supply/pressure passage means to said guide bore next adjacent to said valve seat, a hollow ported poppet valve having a head with a stem journaled in said guide bore, operatively positioned to control fuel flow between said supply chamber and pump chamber via said second passage means and said supply/pressure passage, said stem having a reduced diameter portion next adjacent to said head to define with said guide bore an annulus chamber in flow communication with said second passage means; and, a solenoid means operatively secured to said valve body means, said solenoid means including an armature operatively connected to said stem of said poppet valve and a spring operatively connected to said poppet valve to normally bias said head to an unseated position relative to said valve seat.

2. An electromagnetic unit fuel injector with replaceable, cartridge type solenoid actuated poppet valve, said injector including a housing means having a blind, stepped socket therein defining at the blind end thereof a spill chamber and a fuel supply passage for receiving fuel, a drain passage means in said housing means opening into said spill chamber, a pump cylinder means in one end of said housing means, an externally actuated plunger reciprocable in said cylinder means to define therewith a pump chamber, a valve controlled injection nozzle means at the opposite end of said housing means in flow communication with said pump chamber, a supply/pressure passage means connected at one end to said pump chamber, said solenoid actuated poppet valve including a valve body means adapted to be secured in said socket in hydraulic sealed relationship to said housing means and to partly enclose said spill chamber, said valve body means having a stepped bore therethrough to define a supply chamber and a valve stem guide bore extending therefrom with a valve seat encircling said guide bore adjacent to said spill chamber, a first passage means interconnecting said supply passage to said supply chamber, a second passage means for interconnecting the opposite end of said supply/-pressure passage means to said guide bore next adjacent to said valve seat, a hollow ported poppet valve, having a head with a stem journaled in said guide bore, operatively positioned to control fuel flow between said supply chamber and said pump chamber via said second passage means and said supply/pressure passage, said stem having a reduced diameter portion next adjacent to said head to define with said guide bore an annulus chamber in flow communication with said second passage means; and a solenoid means operatively secured to said valve body means, said solenoid means including an armature operatively connected to said poppet valve and a spring operatively connected to said poppet valve to normally bias said head to an unseated position relative to said valve seat.

* * * * *